US005080691A

United States Patent [19]

Sorensen et al.

[11] Patent Number: 5,080,691

[45] Date of Patent: Jan. 14, 1992

[54] PROCESS FOR THE CONVERSION OF LIGHT OLEFINS TO ETHER-RICH GASOLINE

[75] Inventors: Charles M. Sorensen, Wilmington, Del.; Sadi Mizrahi, Cherry Hill; Samuel A. Tabak, Wenonah, both of N.J.

[73] Assignee: Mobil Oil Corp., Fairfax, Va.

[21] Appl. No.: 505,091

[22] Filed: Apr. 4, 1990

[51] Int. Cl.[5] ..... C10L 5/00

[52] U.S. Cl. ..... 44/448; 568/694; 568/697

[58] Field of Search ..... 44/448; 568/694, 697

[56] References Cited

U.S. PATENT DOCUMENTS

| | | | |
|---|---|---|---|
| 2,046,243 | 6/1936 | Buc | 44/448 |
| 3,904,384 | 9/1975 | Kemp et al. | 44/56 |
| 3,912,463 | 10/1975 | Kozlowski et al. | 44/56 |
| 4,468,233 | 8/1984 | Bruderreck et al. | 44/56 |
| 4,647,703 | 3/1987 | Torck et al. | 568/697 |
| 4,827,045 | 5/1989 | Harandi et al. | 568/697 |
| 4,857,664 | 8/1989 | Huang et al. | 568/695 |

OTHER PUBLICATIONS

*Organic Chemistry*. Fifth Edition by Morrison and Boyd; Allyn and Bacon, Inc.; 1987; pp. 43, 639, 640.

The Merck Index, 11th Edition; Susan Budavari, Editor; 1989 Copyright; "Gasoline", Article 4270, p. 684.

*Primary Examiner*—Jr., Prince Willis

*Assistant Examiner*—R. D. Flatter

*Attorney, Agent, or Firm*—Alexander J. McKillop; Charles J. Speciale; Robert B. Furr, Jr.

[57] ABSTRACT

Light olefins are converted to gasoline with a high enough content of ethers to provide a significant octane improvement over a base (or 'cracking') gasoline (clear RON=90-92; clear MON=79-80). One portion of the olefins is hydrated to produce alcohols, and the other is used to synthesize an olefin-rich gasoline. The alcohols are used to etherify the gasoline. The combination of unit operations minimizes the energy needed to run the process for which no external solvent is needed. The process capitalizes on the higher solubility in gasoline of ethanol, propanol and butanol, compared to methanol. Besides having very low solubility in gasoline, etherification with methanol or ethanol produces an inadequately rewarding increase in octane number, compared to propanol or isopropanol. Taking advantage of the inherent chemical and physical properties of $C_3$-$C_4$ alcohol/gasoline mixtures results both in an unexpectedly high octane number for the ether-rich gasoline as well as an effective and economical process for producing it. The improvement in octane is particularly noteworthy because the weight percent of oxygen in olefinic gasoline etherified with $C_3$-$C_4$ alcohols is less than one-half that of gasoline etherified with either $C_1$ or $C_2$ alcohol.

19 Claims, 2 Drawing Sheets

PROCESS FOR THE CONVERSION OF LIGHT OLEFINS TO ETHER-RICH GASOLINE

BACKGROUND OF THE INVENTION

This invention relates to a process for maximizing the value of light hydrocarbon mixtures containing one or more lower olefins ($C_2^{=+}$) such as those typically available in a petroleum refinery, for use in gasoline. Since maximizing the value of the mixtures requires forming a $C_3$–$C_4$ monohydric acyclic alcohol to be used as a reactant in an etherification (or "etheration") reaction, a preferred stream for hydration is a stream containing at least 30% $C_3$–$C_4$ olefins ($C_3^{=}$–$C_4^{=+}$), and more than 10% by weight (% by wt) of the olefins is propylene or $C_3^{=+}$ (propylene and heavier olefins).

Preferred streams of lower olefins to be upgraded consist essentially of predominantly (more than 50% by wt) $C_3$–$C_4$ olefins; or, light naphtha; either of which may sometimes be mixed with a $C_4$ byproduct containing a $C_4^{=}$ fraction from an ethylene plant or the like, so that the mixture in the stream has less than 70% by wt, and preferably less than 30% by wt of $C_2$–$C_5$ paraffins. Such streams are generated in cracking and visbreaking units. For example, one available FCC (fluid catalytic cracking) stream may be predominantly $C_3$–$C_4$, and another, a light naphtha stream may be predominantly $C_4$–$C_5$, with a substantial portion of the olefins in each stream being just outside the specified range.

Because the light hydrocarbon mixture usually contains $C_3$–$C_5^{=}$ among which $C_3^{=}$ together with $C_4^{=}$ predominate, and in such ,a mixture either $C_3^{=}$ or $C_4^{=}$ may predominate, the mixture is referred to herein as a "lower olefin feed stream". The object is to upgrade such feed streams to as high a value for use as gasoline ("gasoline value") as can be justified by the cost of equipment and energy required to upgrade the streams.

More specifically, this overall process relates to a unique scheme for upgrading one or more light olefin-containing feed streams into an ether-rich gasoline product, without resorting to use of any hydrocarbon stream not derived from the feed stream(s), and with a minimum expenditure of energy since liquid-liquid extraction columns are far more energy-efficient than distillation columns. In the basic mode illustrated in FIG. 1, our process does not require a distillation column, though, as illustrated in FIG. 2, distillation columns may be used to tailor the feeds for the gasoline stream used in the extraction column. Of course if a gasoline stream containing $C_5$–$C_{10}^{=}$ is available in the refinery, and at least 10% of the olefins in such a stream consist of tertalkenes such as isoamylenes, isohexenes and isoheptenes, upgrading the lower olefins is unnecessary.

Much effort has been expended in the prior art to upgrade gasoline by blending methyl, propyl or isopropyl ethers of t-butyl ether with gasoline range hydrocarbons, and to do so by minimizing operating costs. Amongst numerous such processes, examples are provided in U.S. Pat. Nos. 4,664,675 (Class 44/subclass 60) and 4,647,703 to Torck et al (Class 568/subclass 697). Because they chose to etherify gasoline with methanol they could not discover the advantages of etherifying with $C_2^{+}$ secondary alcohols, preferably $C_3$–$C_4$ alcohols. Further, they extracted with water, not gasoline.

In U.S. Pat. No. 3,904,384 (Class 44/subclass 56) to Kemp et al, ether-rich gasoline was produced from a single source of $C_4$ hydrocarbons by cracking to produce propylene and isobutene which are separated. They then hydrate the propylene and etherify the isobutene with the propanol to obtain isopropyl t-butyl ether which is blended with an available stream of gasoline boiling range hydrocarbons. No extraction step is required. In U.S. Pat. No. 4,393,250 (Class 568/subclass 697) to Gottlieb et al, isopropyl alcohol (IPA) was produced from propylene, and the IPA was used to etherify isobutene. They extract their ether-alcohol mixture with water and use a profusion of distillation columns to make the other separations required. We know of no combination of such hydration and etherification processes in which, starting with lower olefins, olefinic gasoline is used both in an etherification reaction, as well as solvent for isopropanol and higher alkanols ($C_3^{+}$) used in the reaction.

Our integrated process combines several subordinate processes, referred to as "root processes", in the first one of which a portion of the light olefins are converted by hydration into an aqueous stream (referred to as an "alcoholic effluent") containing a mixture of aliphatic alkanols, a large portion of which mixture is $C_3^{+}$; in a second root process, the remaining portion of the light olefin stream, or part of it, is oligomerized to yield a gasoline stream (an intermediate or 'process' gasoline stream referred to simply as "gasoline stream" for brevity, and to distinguish it from "product gasoline" made by the process) tailored to contain essentially only those aliphatic hydrocarbons having at least 5 carbon atoms ($C_5^{+}$), a major portion of which are linear, that is, straight or branched chain olefins ($C_5^{=+}$), and a relatively large proportion of these, at least 10% by wt, and preferably at least 30% by wt, are tert-alkenes or isoalkenes; in a third root process the alcohols are extracted from the alcoholic effluent and transferred to the gasoline in a liquid-liquid extraction step; in a fourth root process, the gasoline stream, with a stoichiometric amount of a $C_3$ or $C_4$ secondary alcohol, based on the molar amount of tert-alkenes, is reacted in the presence of a solid acidic catalyst, to yield an etherified (or 'etherated') effluent comprising etherated gasoline, unreactive $C_5^{+}$ hydrocarbons, unreacted $C_5^{=+}$ (from the gasoline stream), and unreacted alcohols, though even less than a stoichiometric amount of secondary alcohol may be used; and, in a fifth root process, the effluent from the etheration reactor comprising remaining unreacted olefins, and alcohols, and unreactive paraffins and other components in the gasoline, and, the etherated gasoline are extracted with water from the etherated effluent to yield the "product gasoline" stream (referred to above) containing an octane-enhancing quantity of di-$C_3^{+}$ alkyl ethers in essentially all of which, one alkyl group has at least 3 carbon atoms ($C_3^{+}$) and the other at least 5 ($C_5^{+}$).

More specifically, unless the tailored $C_5^{=+}$ happens to be available, the effectiveness of the overall process is initially predicated upon the double-barreled ability (A) to produce the tailored stream by oligomerizing the light olefin feed stream in an oligomerization zone, such as the reaction zone of a Mobil Olefin to Gasoline ("MOG") or Mobil Olefin to Distillate ("MOD") process, and, (B) to produce an alcoholic effluent, preferably having a major portion by weight of a monohydric alcohol, preferably a secondary alcohol having at least 3 carbon atoms ($C_3^{+}$). Thereafter, it so happens that it is not particularly important what the extraction factor for the $C_3^{+}$ alcohols is, when they are extracted into the tailored ($C_5^{=+}$) gasoline stream, because it is not essential that all the tert-olefins in the gasoline stream be etherated to provide an unexpectedly high octane boost. What is important, is that, a gasoline stream containing $C_5$–$C_{10}^{=+}$ is especially well-adapted under the circumstances to extract sufficient secondary alcohols from the alcoholic effluent to provide a mixture which can be etherified without making any separation of components in the feed from the extraction column to the etheration zone.

Extraction with the gasoline stream fortuitously happens to provide the secondary alcohols which are economically desirable, because they are sufficiently reactive under chosen conditions in an etherification reaction zone, to etherify essentially only the tert-olefins in the $C_5^{=+}$ stream to yield asymmetrical di-$C_3^+$ alkyl ethers, and particularly $C_3^+$ alkyl-t-$C_5^+$ alkyl ethers, which produce the unexpectedly high boost in octane, relative to methyl or ethyl-t-$C_5^+$ alkyl ethers, based on the oxygen content (wt % O) contributed by the ethers. Gottlieb et al, supra, used a $C_4$ fraction containing isobutene to extract isopropyl or sec-butyl alcohol but found it necessary to separate the alcohol from the organic phase by distillation before feeding the alcohol and byproducts (for example, di-isopropylether) to the etheration reactor. The isopropyl alcohol and sec-butyl alcohol are reacted with isobutene to produce isopropyl-t-butyl ether and sec-butyl-t-butyl ether. Even if they had tested the octane boost contributed by their combined t-butyl ethers, they would not have known that t-amyl ethers provided a superior octane boost based on % by wt of oxygen in the etherate. To improve the boost contributed by the t-butyl ethers formed with the $C_3$ and $C_4$ alcohols, the Gottlieb et al '250 reference teaches the addition of methyl-t-butyl ether (MTBE).

The ability of lower alkyl ethers to function as octane boosters in gasoline has focused the attention on methanol which is used (i) to etherify isobutylene to yield MTBE, or, (ii) to etherify isoamylenes to yield methyl tert-amyl ether. Methanol is plentiful, and is known to etherify an isoalkene more readily than other secondary or tertiary olefins. By "isoalkene" I refer to a t-monoolefin having the double bond on the tertiary C atom. In the past, methanol was preferred for reaction with $C_4$–$C_7$ isoolefins, as specifically taught in U.S. Pat. No. 4,544,776 (Class 568/-subclass 697) to Osterburg et al., presumably because of the known reactivity of primary alcohols in the etherification of isoolefins.

But we discovered not only that etherification of a ($C_5^{=+}$) stream with $C_3$–$C_5$ alcohols, including secondary alcohols, proceeded apace and with gratifying selectivity, but that "base" ($C_5^{=+}$) gasoline (RON 93.7; MON 79.1, for example) boosted with an isopropyl ether of the ($C_5^{=+}$) isoalkenes has a surprisingly higher octane than it has when boosted with a methyl ether of the ($C_5^{=+}$) isoalkenes. This discovery provided the impetus to search for a way to provide a ($C_5^{=+}$) stream, and a $C_3^+$ alcohol stream containing isopropyl and higher alcohols, each stream in condition to be reacted under the appropriate catalytic etherification conditions, and to find a way to recover the product gasoline economically, without resorting to a distillation column.

In the embodiments described hereinafter, it may be desired to operate a MOG reactor in a MOG process, if the amount of distillate range hydrocarbons made in the reactor is to be minimized; however, it may be desired to operate a MOD reactor in a MOD process, if the amount of distillate range hydrocarbons made in the reactor is to be maximized and the distillate recovered, prior to using the gasoline range hydrocarbons for solvent. Reference is made to either the MOG or the MOD mode, or both modes of the process, by designating the "MOG/D" mode. Specific reference to one mode or the other is made by reference to each as being either the MOG or MOD mode.

Under the chosen circumstances, selection of the MOG (or an analogous) process to provide the ($C_5^{=+}$) stream was easy, but any inclination to pursue the hydration of an olefin stream to produce the $C_3^+$ alcohol stream was quickly vitiated by the expense of separating the alcohols and desired secondary alcohols, namely isopropyl or isobutyl and isoamyl alcohols, from an alcoholic effluent which contained a major proportion by weight of water. Separation of the alcohols is avoided in our process, as is separation of the $C_5^{=+}$ content of the MOG/D effluent. It may be economical to make such separations by distillation, prior to extraction, to provide the optimum ratio of alcohols and water, and/or optimum concentration of $C_5^{=+}$ in the extraction column.

The reaction of methanol with isobutylene, isoamylenes, and higher tertiary olefins, at moderate conditions with a resin catalyst is taught by R. W. Reynolds et al in *The Oil and Gas Jour.* June 16, 1975; by S. Pecci and T. Floris in *Hydroc, Proc.* Dec 1977; and, by J. D. Chase et al in *The Oil and Gas Jour.* Apr 16, 1979 pg 149–152. The preferred catalyst is Amberlyst 15 sulfonic acid resin available from Rohm and Haas Corp. None teaches etherification of $C_5^{=+}$ olefins, and particularly $C_5$ to $C_9$ isoolefins with $C_3^+$ alcohols, or isopropyl alcohol, for any reason. There was no reason to expect that the effectiveness of an isopropyl or $C_3^+$ etherate of a $C_5^{=+}$ gasoline should be many times more effective on the basis of its oxygen content (percent by weight O), than a methyl or ethyl etherate of the same $C_5^{=+}$ gasoline.

SUMMARY OF THE INVENTION

It has been discovered that a $C_3^+$ (propyl, isopropyl or higher) etherate of a $C_5$–$C_{10}^=$ olefin-containing stream is many times more effective as an octane booster, on the basis of weight percent oxygen (% by wt O) in the etherate, than a methyl etherate of the same olefin stream when each is used in a "base" gasoline containing a major proportion by weight of $C_5$–$C_{10}$ hydrocarbons.

It has also been discovered that a gasoline stream such as an effluent synthesized in a MOG/D reaction zone, (which stream is distinguished from "product gasoline" formed), containing gasoline range olefins ($C_5$–$C_{10}^=$) including at least 15% by wt tert-olefins, is an unexpectedly effective solvent for extracting $C_3^+$ alcohols from an alcoholic effluent generated in an olefin hydration reaction zone in which a linear lower olefin feed stream containing a substantial portion of $C_3$–$C_4$ olefins, preferably at least 30% by wt $C_3$–$C_4^=$ olefins, is catalytically hydrated.

It is therefore a general object of this invention, when a $C_5$–$C_{10}^=$-containing gasoline stream having at least 10% tert-olefins is available in a refinery, to provide a process for the overall purpose of upgrading the value of both the gasoline stream and a light $C_2$–$C_6$ hydrocarbon mixture containing at least 30% by wt lower $C_3$–$C_4$ olefins (the light hydrocarbon mixture is referred to herein as the "lower olefin feed stream"), by converting both into a product gasoline stream consisting essentially of (i) etherated $C_5$–$C_{10}$=-containing gasoline, etherified (or etherated) with $C_3$–C-4 alcohols, and, (ii) $C_5$–$C_{10}$=-containing gasoline; the process comprising, (a) hydrating the light olefin feed stream under hydration conditions, preferably in the presence of a hydration catalyst, to produce an alcoholic effluent in which at least 40% of the olefins in the feed stream is converted to a mixture of alcohols in which $C_3$–$C_4$ alcohols are present in a major proportion by weight relative to the total alcohol content, (b) extracting the mixture of alcohols from the alcoholic solution into the $C_5$–$C_{10}$=-containing gasoline (the solvent) under extraction conditions favorable to selective extraction of the mixture, until enough secondary alcohols are extracted into the extract to etherify at least 80% by wt of the tert-olefins in the gasoline solvent, and there is less than 5% by wt of $C_5$–$C_{10}$=-containing gasoline in the raffinate, (c) etherifying the extract in the presence of an acidic catalyst under etherification conditions to produce an etherated effluent consisting essentially of (i) asymmetrical $C_8$+ dialkyl ethers (having a total of 8 or more C atoms) of the $C_5$–$C_{10}$=-containing gasoline, and, (ii) $C_5$–$C_{10}$=-containing gasoline in which at least 90% of the non-tert-olefins are left unreacted, and, (d) extracting the etherated effluent with water under extraction conditions favorable to selective extraction of unreacted $C_3$–$C_4$ alcohols, to yield product gasoline essentially free from the unreacted $C_3$–$C_4$ alcohols.

whereby the process requires no distillation column to produce the product gasoline.

It is also a general object of this invention, when the aforesaid $C_5$–$C_{10}$=-containing gasoline stream is not available in the refinery, to provide a self-contained, integrated process for the overall purpose of upgrading the value of the lower olefin feed stream, comprising, oligomerizing a first portion of the feed stream to yield a predominantly $C_5$–$C_{10}$=-containing gasoline stream containing at least 15% tert-alkenes, and, hydrating a second portion of the lower olefin feed stream to produce an alcoholic effluent, as described immediately hereinabove; the relative proportions of the feed stream to be converted are chosen so that upon conversion of at least 40% of the olefins in the second portion to a mixture of alcohols, the amount of $C_3$+ alcohols extractable from the alcoholic effluent by the $C_5$–$C_{10}$=-containing gasoline is sufficient to provide a sufficient quantity of $C_3$+ secondary alcohols in the extract to etherify at least 80% of the tert-olefins in the gasoline stream, to yield an etherate in which each alkyl group is $C_3$+ (has at least 3 C atoms); whereby the lower olefin feed stream is upgraded to product gasoline having a surprisingly high boost in octane number, on the basis of its oxygen content (% by wt), without using a hydrocarbon stream not generated from the feed stream.

It is a specific object of this invention, when the aforesaid $C_5$–$C_{10}$=-containing gasoline stream is not available in the refinery, to provide a self-contained, integrated process for the overall purpose of upgrading the value of more than one lower olefin feed stream, in one of which either the $C_3$= or the $C_4$= olefin is the predominant olefin by weight; and, in another feed stream, the $C_3$–$C_4$= are present in a minor amount by weight; concurrently feeding the latter feed stream to the MOG/D reaction zone, and the former to the hydration zone; and, processing the effluents from each zone as before.

It is another specific object of this invention to practice the foregoing invention by tailoring either the alcohol-containing or gasoline-containing streams, or both, to the extraction column by using distillation columns to do so.

It is also a specific object of this invention, to provide a product gasoline, free of an alkyl lead additive, which product gasoline is characterized by the presence of $C_5$–$C_{10}$ hydrocarbons containing at least 30% by wt of non-tert-$C_5$–$C_{10}$=, and, at least 10% by wt of asymmetrical $C_8$+ dialkyl ethers essentially free of an alkyl ether of a $C_5$=+ (olefin having less than 5 C atoms).

It is another specific object of this invention, to provide the aforesaid product gasoline, from at least one lower olefin feed stream, and no other hydrocarbon feed stream, by concurrently feeding the lower olefin to a MOG/D reaction zone and a hydration zone to yield an essentially $C_5$–$C_{10}$=+-containing gasoline stream containing at least 15% by wt of tert-olefins, and, an aqueous alcoholic effluent, respectively, then extracting the alcoholic effluent with the $C_5$–$C_{10}$=+ effluent from the MOG/D reaction zone, so as to make the necessary separations adequately with single-stage separation zones, thus avoiding the use of a distillation column in the process.

It is yet another specific object of this invention, to provide the aforesaid product gasoline in which the presence of at least 10% by wt of the isopropyl ether of tert-olefins in the $C_5$–$C_{10}$=+ range, provide at least a five-fold improvement in octane boost, based on % by wt oxygen in the isopropyl ethers, than the octane boost contributed by the methyl ethers of the same t-olefins.

BRIEF DESCRIPTION OF THE DRAWINGS

The foregoing and other objects and advantages of our invention will appear more fully from the following description, made in connection with the accompanying drawing, of preferred process schemes embodying the invention, wherein.

DETAILED DESCRIPTION OF PREFERRED EMBODIMENTS

Figure 1:
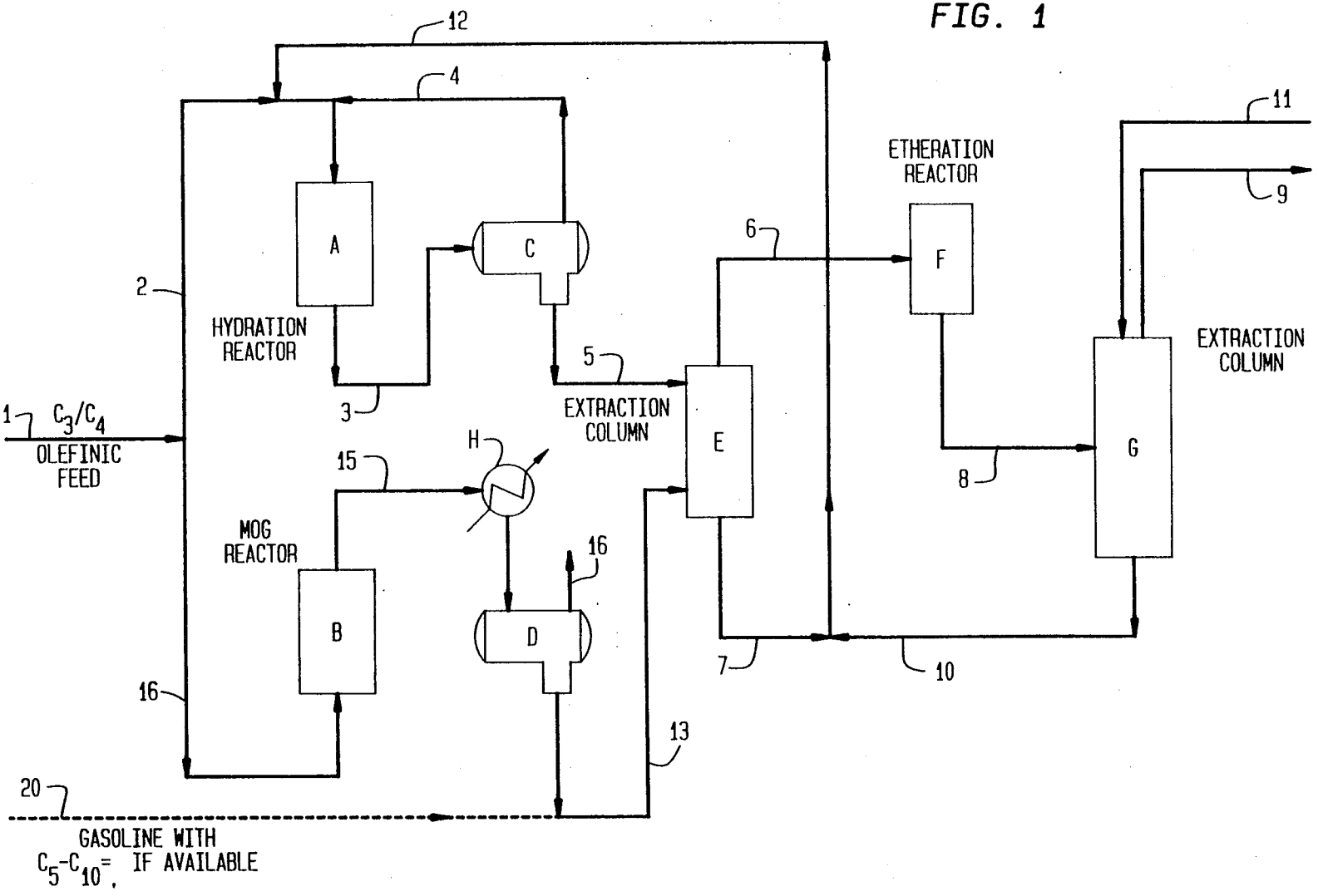
FIG. 1 is a flowsheet schematically illustrating a self-contained, integrated process in which a $C_3$–$C_4$ olefin-containing stream is proportioned to MOG and hydration reactors respectively, and neither of their effluents is tailored to provide an optimum ratio of alcohols to water for the extraction column; or, to provide a $C_5$–$C_{10}$=+ stream substantially free of lower olefins.

The effectiveness of our process is in large part due to the use of an oligomerized or synthetic gasoline rather than a base (FCC) gasoline, because the former has more branched chain olefins which have higher reactivity compared to linear olefins. The ratio of branched/-linear in oligomerized (MOG/D) gasoline is greater than 2.5, while the ratio for FCC gasoline is typically no more than about 2.5 (see Tables 1 and 2 and Examples 1 and 2, herebelow). The higher ratio of branched/linear in MOG/D gasoline results in it being a more effective solvent for extraction of alcohols, compared to a base gasoline with a ratio no greater than 2.5 (see Tables 3 and 4 herebelow).

The following comparative analysis illustrates the difference in the content of branched tertiary olefins in a tailored olefin-rich gasoline such as MOG gasoline, and a conventional FCC gasoline. Table 1 provides a GC (gas chromatographic) analysis of the $C_5$ olefins ($C_5$=) and Table 2 provides a GC analysis of the $C_6$= olefins. It is seen that the ratio of branched to linear olefins is at least 50% higher for the tailored gasoline. This ratio is at least as high for $C_7$=+ (olefins higher than $C_6$=).

TABLE 1

| Identif. of $C_5$= | Distribution of $C_5$= isomers FCC Gasoline | MOG Gasoline |
|---|---|---|
| 1-pentene | 1.93 | 0.58 |
| trans-pentene | 4.39 | 3.11 |
| cis-2-pentene | 2.47 | 1.56 |
| 2-methyl-1-butene | 3.34 | 3.64 |
| 2-methyl-2-butene | 6.49 | 13.70 |
| 3-methyl-1-butene | 0.58 | 0.38 |
| Total Branched | 10.41 | 17.72 |
| Total Linear | 8.79 | 5.25 |
| Branched/Linear Ratio | 1.2 | 3.4 |

TABLE 2

| Identif. of $C_6$= | Distribution of $C_6$= isomers FCC Gasoline | MOG Gasoline |
|---|---|---|
| cis-2-hexene | 1.03 | 2.27 |
| trans-2-hexene | 1.80 | 0.97 |
| trans-3-hexene | 1.22 | 0.00 |
| 2-methyl-1-pentene | 2.23 | 2.14 |
| 3-methyl-1-pentene | 0.72 | 0.01 |
| 4-methyl-1-pentene | 1.09 | 0.56 |
| 2-methyl-2-pentene | 2.39 | 1.04 |
| 3-methyl-cis-2-pentene | 1.45 | 6.60 |
| 3-methyl-trans-2-pentene | 1.83 | 2.27 |
| 4-methyl-cis-2-pentene | 0.00 | 2.10 |
| 4-methyl-trans-2-pentene | 0.00 | 0.01 |
| 3,3-dimethyl-1-butene | 0.25 | 0.00 |
| 2,3-dimethyl-2-butene | 0.14 | 0.00 |
| Total Branched | 10.10 | 13.32 |
| Total Linear | 4.05 | 3.24 |
| Branched/Linear Ratio | 2.5 | 4.1 |

From the foregoing it is evident that the higher reactivity of the tailored olefin-rich gasoline in the etherification reaction is accounted for by the higher ratio of branched to linear olefins, the branched chain species being more reactive than the linear.

The following comparative analysis illustrates the difference in effectiveness of a branched and a linear olefin respectively as extraction solvents for alcohols. The relative proportions of alcohol and water in the comparison was chosen to match that typically present in the alcohol/water stream leaving the olefin hydration unit (reactor vessel A) shown in the flowsheet FIG. 1.

50 ml of an alcohol-rich feedstock containing 70.11% isopropanol, the remaining being water, is contacted with either 50 ml of 1-hexene, or 3,3-dimethylbutene, by shaking in a glass separatory funnel. The resulting two-phase mixture was separated and analyzed by GC. The material balances are shown in Tables 3 and 4 respectively.

TABLE 3

Single stage extraction of Isopropanol/Water with 1-Hexene.

| | Weight (g) Raffinate | Extract |
|---|---|---|
| water | 8.78 | 3.22 |
| isopropanol | 8.53 | 21.18 |
| 1-hexene | 0.48 | 31.80 |

Calculated distribution coefficient for 1-hexene is 2.5.

TABLE 4

Single stage extraction of Isopropanol/Water with 3,3-dimethylbutene.

| | Weight (g) Raffinate | Extract |
|---|---|---|
| water | 8.39 | 3.86 |
| isopropanol | 7.68 | 23.14 |
| 3,3-dimethylbutene | 0.44 | 31.50 |

Calculated distribution coefficient for 3,3-dimethylbutene is 3.0.

EXAMPLE 1

The MOG gasoline characterized by the analysis of olefins provided in Tables 1 and 2 hereinabove, was etherified over a fixed bed of Amberlyst-15 catalyst at 175° F., 300 psig and 10 LHSV based on catalyst bed volume and total volumetric flow. The ratio of alcohol to gasoline is chosen to provide a 2:1 molar ratio of alcohol to total olefins in the gasoline feedstock. Unreacted alcohol was removed from the products by extraction with water. The water-washed products are then characterized by oxygen analysis to determine the extent of reaction, by standard octane measurements, to determine product quality. Additional oxygen analyses were made by use of an oxygen-specific flame ionization detector (O-FID, ES Industries, Marlton, N.J.). Table 5 summarizes these results for the water-washed products derived from methanol, ethanol, and isopropanol etherification. The absolute change in octane number ("Delta") represents the change in octane value over the base gasoline. In addition, O-FID results found that there were no free alcohols remaining in the water-washed products.

TABLE 5

Etherification of MOG gasoline with $C_1$-$C_3$ Alcohols.

| Etherate | RON | Δ RON | MON | Δ MON | Wt % O |
|---|---|---|---|---|---|
| Base gasoline | 93.7 | 0 | 79.1 | 0 | 0 |
| Methyl- | 93.0 | −0.7 | 79.8 | +0.7 | 3.8 |
| Ethyl- | 94.5 | +0.8 | 80.9 | +1.8 | 2.0 |
| Isopropyl- | 94.4 | +0.7 | 81.0 | +1.9 | 0.6 |

From the foregoing data it is evident that the isopropyl- and ethyl-etherates have improved research and motor octane numbers compared to those of the methyl-etherate, but the isopropyl-etherate produces the octane boost at a much lower oxygen content.

The lower O content for the ethyl- and isopropyl-etherates relative to the methyl is not due to the lower O content per gram of the corresponding alcohol (wt % O is 50, 35 and 27 in methanol, ethanol and isopropanol respectively). The results of O-FID analysis indicate that $C_6$+ ethers were formed from each alcohol reactant, but the extent of this reaction decreased as the molecular weight of the alcohol increased. The same pattern of peaks in the GC traces were displayed for each alcohol, but the peak retention times were shifted to longer times for the products of the heavier alcohols. This indicates that the same reactive olefins were involved in the etherification reactions, irrespective of the alcohol co-reactant.

EXAMPLE 2

FCC gasoline is etherified under the same conditions as in Ex 1 hereabove, except that the temperature is 150° F. and the pressure is 1000 psig. Results for the etherification with methanol and isopropanol are set forth in Table 6 below.

TABLE 6

Etherification of MOG gasoline with $C_1$ & $C_3$ Alcohols.

| Etherate | RON | Δ RON | MON | Δ MON | Wt % O |
|---|---|---|---|---|---|
| Base gasoline | 92.6 | 0 | 80.6 | 0 | 0 |
| Methyl- | 93.0 | +0.4 | 80.7 | +0.1 | 1.4 |
| Isopropyl- | 93.8 | +1.2 | 80.7 | +0.1 | 0.4 |

With both methanol and isopropanol, the wt % O in the etherates is less, and the differences in octane are smaller than those obtained with MOG gasoline. The lower extent of reaction with the FCC gasoline is mainly due to its lower concentration of reactive tertiary olefins, relative to MOG gasoline, as shown in Ex 1.

According to one particularly preferred embodiment of the invention, a single $C_3$–$C_4$ feed stream preferably containing a major proportion by wt of $C_3$–$C_4$ olefins is used to produce both process streams which provide the reactants for the ether-rich product gasoline to be produced, these streams being (i) the gasoline stream containing $C_5$–$C_{10}$=+ olefins, and, (ii) the lower $C_3$–$C_4$ alkanols, since typically, a suitably tailored olefinic gasoline stream, preferably containing from about 30% to about 50% of tert-olefins, is not readily available in the refinery.

Figure 2:
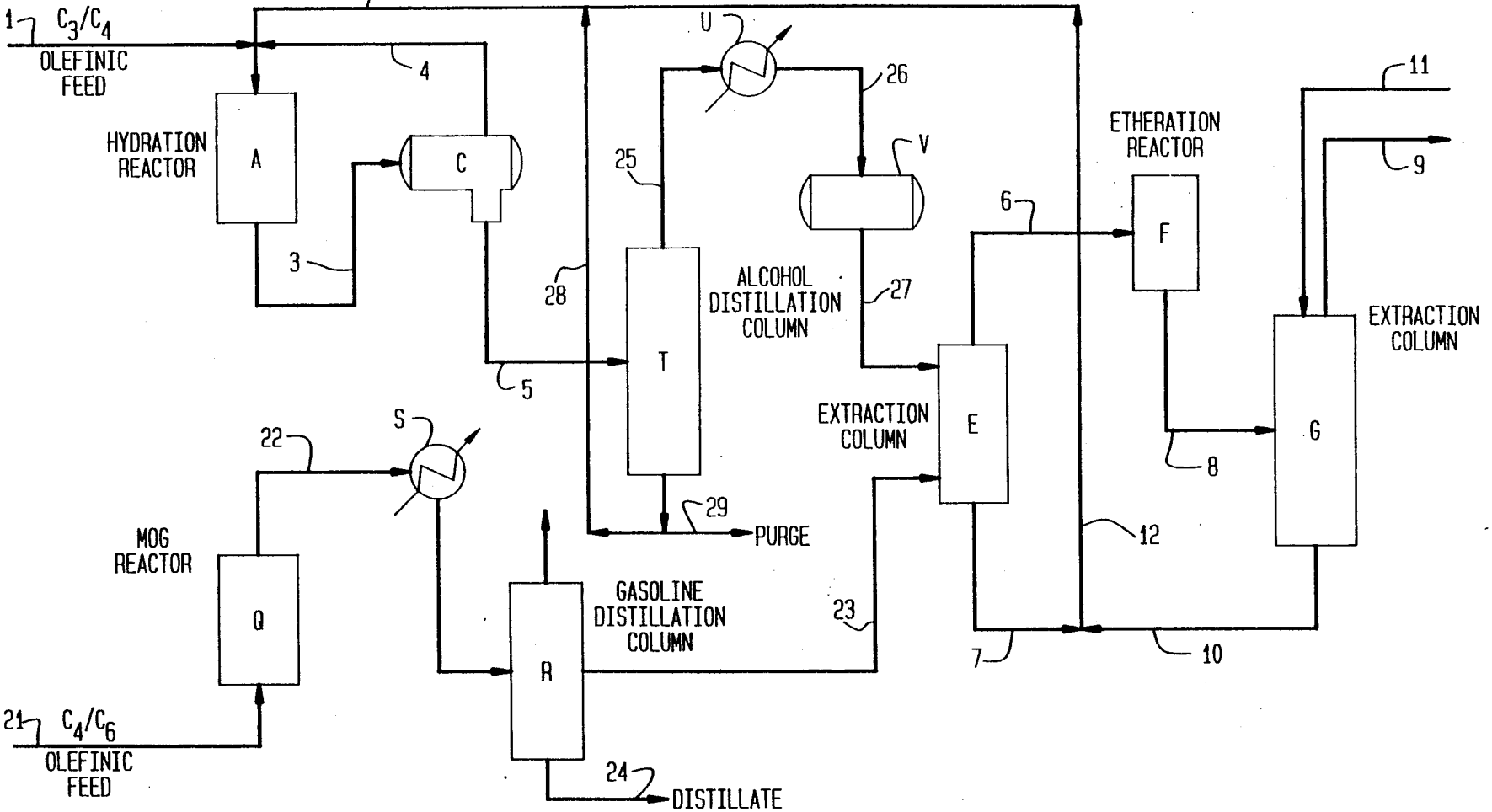
FIG. 2 is a flowsheet schematically illustrating a self-contained, integrated process in which two olefinic feeds are used, the first, a $C_3$–$C_4$=-containing stream is flowed to a hydration reactor; and the second, a $C_4$–$C_6$=-containing stream is flowed to an oligomerization reactor. The effluent from the hydration reactor is shown "cut" by distillation to provide an optimum ratio of alcohols to water for the extraction column; and the effluent from the oligomerization reactor is shown "cut" by distillation to provide an optimum concentration of $C_5$–$C_{10}$=+ in gasoline substantially free of lower olefins, to the extraction column.

To produce both the gasoline stream and alkanols, as schematically illustrated in the simplified flowsheet of FIG. 1, the lower olefin feed stream is introduced through conduit 1 and proportioned concurrently along dual processing paths through conduits 2 and 16 to a hydration reactor A, and an oligomerization reactor B, respectively. If separate lower olefin feed streams are available, as for example a predominantly $C_3$=-rich stream from a fluid catalytic cracking (FCC) unit, and a $C_4$–$C_6$=-rich stream from cracking a relatively heavy hydrocarbon such as gas oil in a cracking furnace to produce ethylene, the $C_3$=-rich stream is fed to the hydration zone A, and the $C_4$–$C_6$=-rich is fed to the oligomerization zone Q, as illustrated in FIG. 2.

Hydration of the lower olefins occurs in a hydration zone provided by a reaction vessel A in which the lower olefins are reacted with water in the presence of a suitable catalyst, to form a mixture of alcohols, a large portion of which are branched chain. The hydration reaction is carried out in a reactor A, in the presence of a hydration catalyst, under conditions of pressure and temperature chosen to yield predominantly $C_3$–$C_5$ alkanols, preferably secondary alcohols. The reaction may be carried out in the liquid, vapor or supercritical dense phase, or mixed phases, in semi-batch or continuous manner using a stirred tank reactor or a fixed bed flow reactor.

It is preferred to carry out the hydration reaction in the liquid phase, for economy. From 1–20 moles of water, preferably from 8–12 moles, are used per mole of alkenes. The space velocity in liters of feed per liter of catalyst per hour is 0.3–25, preferably 0.5–10. The reaction is carried out at a pressure in the range from about 30–100 bar, preferably 40–80 bar and at a temperature in the range from about 100° C. (212° F.) to about 200° C. (392° F.), preferably from 110° C. (230° F.) to 160° C. (320° F.).

One preferred hydration reaction for the lower olefins utilizes a strongly acidic cation exchange resin catalyst, as disclosed in U.S. Pat. No. 4,182,914 to Imaizumi; another hydration reaction utilizes a medium pore shape selective metallosilicate catalyst as disclosed in U.S. Pat. No. 4,857,664 to Huang et al, the disclosures of both of which are incorporated by reference thereto as if fully set forth herein. It is preferred to use phosphonated or sulfonated resins, such as Amberlyst 15, over which a $C_3$=-rich stream forms isopropyl alcohol, and substantially no methanol. By "substantially no methanol" we refer to less than 10% by wt of the alkanols formed. Under the foregoing conditions more than 50% of the alkenes are converted to alkanols, and preferably from 80% to 90% of the propene is converted, with recycle of unreacted olefins to the hydration reactor, to isopropyl alcohol and di-isopropyl ether. In an analogous manner, butenes are converted to branched chain butyl alcohols and $C_4$-alkyl ethers. The effluent from the hydration reactor A leaves under sufficient pressure, typically about 20 bar, to keep unreacted olefins in solution with an aqueous alcoholic solution. This effluent, referred to as the "hydrator effluent", leaves through conduit 3 to be separated in separation zone.

The separation zone comprises a separation means C, preferably a relatively low pressure zone, such as a flash separator, which functions as a single stage of vapor-liquid equilibrium, to separate unreacted olefins from the aqueous alcoholic effluent, referred to as hydrator effluent. The unreacted olefins are recycled from the flash separator C to the hydration reactor A through conduit 4.

Typically the pressure in the flash separator, preferably from about 69 kPa (10) psig to about 140 kPa (20 psig), is slightly higher than the operating pressure of a liquid-liquid extraction means E to which the substantially olefin-free hydrator effluent is flowed through conduit 3, for extraction of the alcohols. The hydrator effluent may be cooled by heat exchange with a cool fluid in a heat exchanger (not shown), to lower the effluent's temperature in the range from about 27° C. (80° F.) to about 94° C. (200° F.) to provide efficient extraction with gasoline, as will be explained herebelow.

Referring further to FIG. 1, lower olefins fed to an oligomerization zone through conduit 16 are oligomerized in MOG reactor B over a medium pore size siliceous metallosilicate catalyst of the type known as ZSM-5, under oligomerization conditions chosen to convert the $C_3$–$C_4$= olefins, to higher predominantly acyclic hydrocarbons, at least 40%, and preferably more than 50% of which are $C_5$–$C_{10}$=+ olefins.

Operating details for MOG/D reactors and related equipment are taught in U.S. Pat. Nos. 4,456,779 and 4,497,968 to Owen et al, in U.S. Pat. No. 4,433,185 to Tabak et al, and in U.S. Pat. No. 4,859,308 to Harandi et al, inter alia, the disclosures of which are incorporated by reference thereto as if fully set forth herein.

In the embodiment illustrated in FIG. 1, preferred operating conditions for the MOG reactor B are deliberately chosen so that no more than a very small portion, typically less than 10% by wt of the effluent is $C_{10}^+$ (distillate range hydrocarbons); and, this small portion is not separated from the MOG reactor effluent which flows through conduit 15, and is condensed in partial condenser H. The condensate is collected in flash separator D from which uncondensed components are purged through line 16. ZSM-5 type of catalysts are usually synthesized with Bronsted active sites by incorporating a tetrahedrally coordinated metal, such as Al, Ga, or Fe within the zeolytic framework. ZSM-5 crystalline structure is readily recognized by its X-ray diffraction pattern as described in U.S. Pat. No. 3,702,866 to Argauer et al, the disclosure of which is incorporated by reference thereto as if fully et forth herein.

The MOG reactor B may be a fixed bed, moving bed or fluid bed operating at a temperature in the range from about 200° C. (392° F.) to about 400° C. (752° F.) and pressure in the range from about 400 kPa (60 psia) to about 5600 kPa (800 psia). The reactor B is preferably operated to provide mainly $C_5$–$C_{10}^=$ with iso-pentenes, iso-hexenes and iso-heptenes maximized.

If a suitable gasoline stream containing the requisite minimum amount of tert-olefins in the $C_5$–$C_{10}^{=+}$ range is available in the refinery, it may be flowed through conduit 20 (drawn as a dashed line to indicate that its use is an option) and used directly in extractor means E to extract the alcohols from the hydrator effluent. As will be evident to one skilled in the art, the desired composition of the ether-rich product gasoline, the conditions of the etheration reaction, and the particular composition of primary and secondary alcohols in the hydrator effluent, inter alia, will determine the mass flow of the gasoline stream.

Condensed effluent from flash separator D comprises mainly $C_5^+$ hydrocarbons preferably having about 40–60% by wt, or more, of $C_5$–$C_{10}^{=+}$ olefins, the remaining being unreacted paraffins, aromatics, etc. and including a negligibly small amount of paraffins and olefins in the $C_2$–$C_4$ range which remain condensed in the $C_5$–$C_{10}^+$ hydrocarbon stream after flash separation.

The $C_5$–$C_{10}^=$-containing gasoline stream is withdrawn from flash separator D through conduit 13 and used as solvent in liquid-liquid extractor E because such a gasoline stream, essentially free from $C_4^=$ (butenes and lower) has been found to be especially suitable to extract isopropyl alcohol and other higher branched chain alcohols in the aqueous alcoholic effluent, and this gasoline stream is essentially immiscible in water. By "essentially free from $C_4^{=-}$" we refer to a stream having less than 10% by weight of $C_4^{=-}$. The availability of such a gasoline stream containing the requisite minimum amount of tert-olefins, whether such a stream is produced by oligomerization in a MOG/D reactor, or otherwise, together with the ability to produce the requisite hydrator effluent, each without resorting to the use of a distillation column, are the essential requirements and characteristics of the energy-efficient, and economical process illustrated in FIG. 1.

The gasoline stream is fed to extraction means E through conduit 13, along with the substantially olefin-free hydrator effluent from separator C. Typically the ratio of weight of aqueous alcohol fed per hour through conduit 5 to E, to that of the weight of $C_5$–$C_{10}^=$ gasoline fed through conduit 13 is in the range from about 4:1 to about 1:4. The process conditions in column E are chosen to extract the alcohols from the alcoholic solution, into the gasoline stream while the aqueous and organic phases are flowing through E as liquids. Though extraction may be carried out at elevated temperature and atmospheric pressure, relatively lower temperatures than the operating temperature of the flash separator, and pressure in the range from about 170 kPa (10 psig) to about 1135 kPa (150 psig) is preferred. The raffinate consists essentially of gasoline range hydrocarbons and alcohols which are fed to etheration reactor F. The solvent phase from E consists essentially of water with less than 5% by wt of alcohols, and a negligible amount, less than 1% by wt of hydrocarbons. This solvent phase is flowed through conduit 7 and recycled to the hydration reactor.

The particular type of extractor means used is not critical provided the unit operation is executed efficiently. This may be done in co-current, cross-current or single stage contactors as taught in The Kirk-Othmer Encylopedia of Chemical Technology, (Third Ed.) pp 672–721 (1980) and other texts, using a series of single stage mixers and settlers, but multistage contactors are preferred. The operation of specific equipment is disclosed in U.S. Pat. Nos. 4,3349,415 to DeFilipi et al, and U.S. Pat. No. 4,626,415 to Tabak. Most preferred is a packed column, rotating disk, or other agitated column, using a countercurrent multi-stage design.

When isopropanol (IPA), produced in the hydration reactor A is reacted with 2-methyl-1-butene, tert-amyl-isoproyl ether is formed. In an analogous manner, when sec-butyl alcohol is reacted with isohexene, tert-hexyl-2-butyl ether is formed. The ratio of isopropyl ethers to sec-butyl ethers produced in the etheration reactor F will be related to the ratio of IPA to sec-butyl alcohol produced in the hydration reactor A, though the conditions in the hydration reactor can be controlled to some extent to control the relative production of isopropyl ethers and sec-butyl ethers. In general, the etherification of the $C_5$–$C_{10}^=$ gasoline stream with branched chain alcohols produces $C_8$–$C_{13}$ branched chain ethers which are essentially free from ethers having less than 8 C atoms ($C_8^-$). As before, by "essentially free" we refer to a stream having less than 10% by wt of $C_8^-$ ethers.

The molar ratio of monohydric alcohols to tertiary olefins in the etheration reactor F is in the range from about 1.02:1 to about 2:1, preferably from about 1.2:1 to 1.5:1, which preferred range of ratio provides conversion of essentially all, typically from 93 to 98% of the tert-olefins, such as the isoamylenes, isohexenes and isoheptenes, and most of the secondary alcohols, typically from more than 50% to 75%, are reacted. The ratio of unreacted secondary and tertiary alcohols to tert-olefins in the etherated effluent is in the range from 50:1 to about 1000:1 on a wt basis, while the combined wt of non-tert-olefins leaving the etheration reactor is essentially the same as that of their weight entering the reactor. In general terms, substantially all the olefins which are not tert-olefins (the "non-tert-olefins"), such as the pentenes, hexenes and heptenes, remain unreacted.

To react essentially all the tert-olefins and isopropyl alcohol and sec-butyl alcohol in the raffinate, the temperature is maintained in the range from about 20° C. (68° F.) to about 150° C. (302° F.) and at elevated pressure in the range from 8 to 16 bar. Under preferred conditions of pressure, in the range from about 1035 kPa (150 psig) to about 2860 kPa (400 psig), the temperature in the etherification zone is controlled in the range between 38° C. (100° F.) to about 93° C. (200° F.) to maximize the etheration of essentially all the tert-olefins with secondary alcohols.

The space velocity, expressed in liters of feed per liter of catalyst per hour, is in the range from about 0.3 to about 50, preferably from 1 to 20.

Preferred etheration catalysts are the cationic exchange resins and the medium pore shape selective metallosilicates such as those disclosed in the aforementioned '914 Imaizumi and '664 Huang et al patents, respectively. Most preferred cationic exchange resins are strongly acidic exchange resins consisting essentially of sulfonated polystyrene, manufactured and sold under the trademarks Dowex 50, Nalcite HCR, Amberlyst 35 and Amberlyst 15.

The etherated effluent from the reactor F, which effluent contains a minor proportion, preferably less than 20% by wt of unreacted alcohols, is flowed through conduit 8 to a second liquid-liquid extractor G where the etherated effluent is contacted with solvent wash water which extracts the alcohols. The conditions for extraction of the etherated effluent with wash water are as not critical. Extraction column G is conveniently operated at ambient temperature and substantially atmospheric pressure, and the amount of wash water used is modulated so that the aqueous alcoholic effluent from extraction column G, combined with the aqueous solvent phase from the extraction column E, is approximately sufficient to provide reactant water in the hydration reactor A.

The raffinate from extraction column G flowing through conduit 9 is an ether-rich gasoline product ("product gasoline") which is a mixture of etherated gasoline and other components in the gasoline range.

Referring now to FIG. 2 there is schematically illustrated a flowsheet, showing only the main components for unit operations in the process, wherein more than one feed containing lower olefins in different molecular weight ranges is available, it is desired to make distillate operating a MOD reactor, and the effluents from both the MOD and hydration reactors are to be "cut" in distillation columns to provide a substantially $C_5$–$C_9$= or $C_5$–$C_{10}$= stream and the alcohol content of the hydration effluent, relative to water, is maximized. It will be recognized that, though the effluents of both the MOD and hydration reactors are "cut" in the process scheme illustrated, economic considerations may dictate that only one or the other be cut, so that only one distillation column may be used.

Whatever the reason for making distillate, enough distillate must be present in this process stream to warrant recovering the distillate in a distillation column. Typically, if a $C_5$+ gasoline range stream, containing $C_5$–$C_{10}$=+ olefins and enough distillate to justify its recovery, is available in the refinery, the stream is prefractionated to yield the desired distillate, and the recovered $C_5$–$C_{10}$=+ gasoline range stream is directly used in extraction column E, as described in FIG. 1 hereinabove.

In the particular situation in a refinery where the $C_5$+ gasoline range stream containing $C_5$–$C_{10}$=+ olefins and enough distillate to justify its recovery is not available, but is to be produced by upgrading an available $C_2$–$C_4$= or $C_3$–$C_4$= or $C_4$–$C_6$=+ stream containing the heavier olefins, as shown in FIG. 2, the available olefin-containing feed stream is flowed through conduit 21 and oligomerized in a MOD reactor Q. The conditions of operation for the MOD reactor Q are chosen to provide not only the desired per pass conversion in the reactor and the mol wt range of hydrocarbons in the distillate, but also the preferred range of tert-olefins in the gasoline range stream to be recovered for use in the etheration reactor, as described in the aforesaid references, inter alia. The effluent from the MOD reactor Q flows through conduit 22 an is partially condensed in heat exchanger S before it is flowed to distillation column R.

Depending upon the composition of the ether-rich product gasoline sought, the desired $C_5$–$C_9$= or $C_5$–$C_{10}$= content of the MOD effluent is cut from the distillation column, for example, by removing the desired cut from an intermediate plate in the mid-zone of the distillation column R, above the bottoms draw-off for distillate through conduit 24.

The $C_3$–$C_4$= feed is hydrated in hydration reactor A, and the alcoholic effluent flowed through line 5 as described hereinabove, but is then flowed to distillation column T. The overhead from the column is typically an azeotrope of alcohols and water, but may be a tailored ratio of alcohols to water. This overhead is led through line 25 and condensed in condenser U and flowed through line 26 to overhead drum V. A controlled flow of the alcoholic effluent is flowed through line 27 to extraction column E. Bottoms from column T is mainly water which is recycled through line 28 to the hydration reactor A. A purge line 29 is provided to rid the system of heavies.

The mass flow of $C_5$–$C_9$= or $C_5$–$C_{10}$= olefins to the extraction column E is controlled in accordance with the concentration of secondary alcohols in the stream 27. Thereafter, extraction of the alcohols, etheration of the alcoholic raffinate in etheration reactor F, and extraction of the etherated effluent in extraction column G, are carried out in a manner analogous to that described for FIG. 1 hereinabove. Whether the process scheme followed is that illustrated in FIG. 1 or FIG. 2, or one in which only one distillation column is used, the process produces essentially no n-propanol in the hydration zone, and the product gasoline is enriched with from about 1% to about 20% by weight, preferably from about 5–15% (depending upon conversion and other operating variables) of a dialkyl ether having at least 8 C atoms ($C_8$+), and the dialkyl ether is an isopropyl or sec-butyl ether of the $C_5$–$C_{10}$= gasoline; and, it is this dialkyl ether which provides the unexpected improvement in octane number, on the basis of % by wt O, compared to the improvements provided by methyl or ethyl ethers of the same gasoline.

Typically, 15% tert-olefins results in more than 5% ethers by wt in the product gasoline. Since the tailored gasoline used herein may contain from 30% to about 70% tert-olefins, the benefits accrued to the process are much greater than those derived from the presence of only 10% tert-olefins, though the latter benefits will be significant.

The product, ether-enriched gasoline, is unique in that it is essentially free of methyl-tert-butyl ether and consists essentially of (i) $C_5$–$C_{10}$ hydrocarbons in which at least 50% by weight is olefinic $C_5$–$C_{10}$ = and less than 10% and typically, essentially none (less than 1% by wt) of the olefins is a tert-olefin, and, (ii) a mixture of asymmetrical $C_8$+ dialkyl ethers present in an amount from about 5% to about 20% by weight of the gasoline product.

The product gasoline is distinguished over other ether-containing gasolines by its gas chromatographic (GC) trace (spectrum) which serve definitively to "fingerprint" the product gasoline by the distribution of oxygenates in it. The following procedure is followed:

A gas chromatograph is used to separate the constitutents of the gasoline, each of which constituents is sent through an oxygen-specific flame ionization detector (O-FID) which detects only oxygenates (such an instrument is made by ES Industries, Marlton, N.J.). Oxygenates detected include water, molecular oxygen, alcohols, and ethers. The pattern of peaks due to heavy ($C_8$+) ethers is distinctive.

It is the presence of the ($C_8$+) dialkyl ethers in the product gasoline which contributes to the unexpected improvement in octane number, on the basis of the gasoline's oxygen content (% by wt), which improvement is several-fold greater, typically more than five times than that provided by methyl ethers of substantially the same tert-olefins when the ethers in each gasoline is present in the amount of 10% by weight.

Having thus provided a general discussion of how the peculiar relatively high ratio of branched to linear olefins in oligomerized gasoline affects the essential facets of the process to enrich $C_5$-$C_{10}$=-containing gasoline with ethers thereof, and specific illustrations of the best mode of operation of the self-contained process, it is to be understood that no undue restrictions are to be imposed by reason thereof, except as provided by the following claims.

We claim:

1. A self-contained, integrated process for upgrading the value of a lower olefin feed stream, comprising:

(a) proportioning a single source of olefins having 3 and 4 carbon atoms between an oligomerization zone which receives a first portion, and an olefin hydration zone which receives a second portion, (b) converting at least 50% by weight of the $C_3$-$C_4$ olefins in said first portion under oligomerization conditions to yield a predominantly $C_5$-$C_{10}$ olefin-containing gasoline containing at least 15% tert-alkenes flowing from said oligomerization zone as an oligomerized effluent, (c) converting at least 30% by weight of the $C_3$-$C_4$ olefins in said second portion to alcohols under hydration conditions to produce an aqueous mixture comprising isopropyl alcohol and sec-butyl alcohol with $C_3$-$C_4$ primary alcohols, said mixture flowing from said hydration zone as a hydration effluent, (d) extracting said alcohols from said hydration effluent into said gasoline stream under conditions favorable to selective extraction of the mixture until a sufficient quantity of secondary alcohols is extracted into the extract to etherify at least 80% by wt of the tert-olefins in the gasoline solvent, and there is less than 5% by wt of $C_5$-$C_{10}$ olefin-containing gasoline in the raffinate, (e) etherifying the extract in the presence of an acidic catalyst under conditions to produce an etherated effluent consisting essentially of (i) unreacted alcohols, (ii) asymmetrical $C_8$+ dialkyl ethers (having a total of 8 or more C atoms) of the $C_5$-$C_{10}$ olefin-containing gasoline, and, (iii) said gasoline containing $C_5$-$C_{10}$ olefins in which at least 90% of the non-tert-olefins are left unreacted, and, (f) extracting the etherated effluent with water under extraction conditions favorable to selective extraction of unwanted $C_3$-$C_4$ alcohols, to yield product gasoline essentially free from said $C_3$-$C_4$ alcohols, and enriched with etherated tert-olefins;

whereby said lower olefin feed stream is upgraded to said product gasoline without using a hydrocarbon stream not generated from said lower olefin feed stream.

2. The process of claim 1 wherein the relative proportions of said lower olefin feed stream are chosen so that upon conversion of at least 40% of the $C_3$-$C_4$ olefins in said second portion to alcohols, the amount of $C_3$+ alcohols extractable from the hydration effluent by the $C_5$-$C_{10}$ olefin-containing gasoline provides a sufficient quantity of $C_3$+ secondary alcohols in the extract to etherify at least 80% of the tert-olefins therein, and yield product gasoline consisting essentially of (i) gasoline boiling range hydrocarbons containing $C_5$-$C_{10}$ olefins, and, (ii) etherated $C_5$-$C_{10}$ olefins resulting in ethers in which each alkyl group is $C_3$+ (has at least 3 C atoms).

3. The process of claim 1 wherein said product gasoline is enriched with from 1% to about 20% by weight of a dialkyl ether having at least 8 carbon atoms, and said dialkyl ether is selected from the group consisting of isopropyl and sec-butyl ethers of said $C_5$-$C_{10}$ olefins.

4. The process of claim 1 wherein the step (c) said aqueous mixture is essentially free of n-propanol, and said product gasoline is produced without separating the components of a process stream in a distillation zone.

5. The process of claim 2 wherein said oligomerized $C_5$-$C_{10}$ olefin-containing gasoline has a ratio of branched to linear olefins which is greater than 2.5.

6. The process of claim 1 including in addition, separating said oligomerized effluent to provide a tailored $C_5$-$C_9$ olefin-containing or $C_5$-$C_{10}$ olefin-containing gasoline stream containing up to about 70% by weight of said tert-alkenes.

7. The process of claim 1 including in addition, separating said hydration effluent to provide an azeotrope of alcohols and water for use in step (d).

8. A self-contained, integrated process for upgrading the value of a lower olefin feed stream with an available refinery stream consisting essentially of $C_5$-$C_{10}$ olefin-containing gasoline boiling range hydrocarbons ("gasoline"), said process comprising:

a) feeding said fees stream having at least 30% by weight $C_3$-$C_4$ olefins, to an olefin hydration zone, b) converting at least 40% by weight of the $C_3$-$C_4$ olefins in said hydration zone to alcohols under hydration conditions to produce an aqueous mixture essentially free of n-propanol comprising isopropyl and sec-butyl alcohols, said mixture flowing from said hydration zone as a hydration effluent, c) extracting said hydration effluent with said gasoline containing major portion by weight of $C_5$-$C_{10}$ olefins including at least 15% tert-alkenes, under extraction conditions favorable to selective extraction of alcohols, to extract said mixture of alcohols into said gasoline in a first extraction zone, d) reacting essentially all said tert-olefins in said gasoline, with said isopropyl alcohol and sec-butyl alcohol, in the presence of an acidic catalyst under conditions to produce an etherated effluent consisting essentially of (i) unreacted alcohols, (ii) asymmetrical $C_8$+ dialkyl ethers of the $C_5$-$C_{10}$ -containing gasoline, and, (iii) said gasoline in which at least 90% of the non-tert-olefins are left unreacted, and, e) extracting the etherated effluent with water under extraction conditions favorable to selective extraction of unwanted $C_3$–$C_4$ alcohols to yield product gasoline essentially free from said $C_3$–$C_4$ alcohols in a second extraction zone;

whereby the lower olefin feed stream is upgraded to product gasoline having a greater improvement in octane number, on the basis of the oxygen content (% by wt) of said product gasoline, than the improvement provided by a methyl-etherate or ethyl-etherate of said $C_5$–$C_{10}$ olefin-containing gasoline.

9. The process of claim 8 wherein said available refinery stream consisting essentially of $C_5$–$C_{10}$ olefin-containing gasoline has a ratio of branched to linear olefins which is no more than 2.5.

10. The process of claim 8 wherein upon conversion of $C_3$–$C_4$ olefins to said alcohols, the amount of $C_3$+ alcohols extractable from the hydration effluent by the $C_5$–$C_{10}$ olefin-containing gasoline provides a sufficient quantity of $C_3$+ secondary alcohols in the extract to effect the etherification of at least 80% of the tert-olefins therein, to yield a product gasoline consisting essentially of (i) gasoline boiling range hydrocarbons containing $C_5$–$C_{10}$ olefins and (ii) etherated $C_{5-C10}$ olefins resulting in ethers in which each alkyl group is $C_3$+.

11. The process of claim 10 wherein said product gasoline is enriched with from about 5% to about 25% by wt with said $C_8$+ dialkyl ethers, and said dialkyl ethers are selected from the group consisting of isopropyl and sec-butyl ethers of said $C_5$–$C_{10}$ olefins.

12. The process of claim 1, wherein step (d) includes returning the major portion of said $C_{10}$+ components to said hydration zone.

13. The process of claim 1 wherein said oligomerized $C_5$–$C_{10}$ olefins gasoline has a ratio of branched to linear olefins which is greater than 2.5; said product gasoline is enriched with from about 5% to about 25% by weight with said $C_8$+ dialkyl ethers, and said dialkyl ethers are selected from the group consisting of isopropyl and sec-butyl ethers of said $C_5$–$C_{10}$ olefins.

14. An ether-rich gasoline product free of an alkyl lead additive and essentially free from methyl-tert-butyl ether, said gasoline product produced directly from a single source of olefins having a 3 and 4 C atoms ($C_3$–$C_4$ olefins), without blending a base gasoline with ethers in a finishing step, and without separating the components of any process stream in a distillation zone, by a) proportioning said olefins between an oligomerization zone which receives a first portion, and an olefin hydration zone which receives a second portion, b) converting at least 50% by weight of the $C_3$–$C_4$ olefins in said first portion under oligomerization conditions to yield a predominantly $C_5$–$C_{10}$ olefin-containing gasoline containing at least 10% tert-alkenes flowing from said oligomerization zone as an oligomerized effluent, c) converting at least 30% by weight of the $C_3$–$C_4$ olefins in said second portion to alcohols under hydration conditions to produce an aqueous mixture comprising isopropyl alcohol and sec-butyl alcohol with $C_3$–$C_4$ primary alcohols, said mixture flowing from said hydration zone as a hydration effluent, d) extracting acid alcohols from said hydration effluent into said gasoline stream under conditions favorable to selective extraction of the mixture until a sufficient quantity of secondary alcohols is extracted into the extract to etherify at least 80% by wt. of the tert-olefins in the gasoline solvent, and there is less than 5% by wt. of $C_5$–$C_{10}$ olefin-containing gasoline in the raffinate, e) etherifying the extract in the presence of an acidic catalyst under condition s to produce an etherated effluent consisting essentially of (i) unreacted alcohols, (ii) asymmetrical $C_8$+ dialkyl ethers of the $C_5$–$C_{10}$ olefin-containing gasoline, and, (iii) said gasoline containing $C_5$–$C_{10}$ olefins in which at least 90% of the non-tert-olefins are left unreacted, and, f) extracting the etherated effluent with water under extraction conditions favorable to selective extraction of unwanted $C_3$–$C_4$ alcohols, to yield product gasoline essentially free from said $C_3$–$C_4$ alcohols, whereby said lower olefin feed stream is upgraded to said product gasoline without using a hydrocarbon stream not generated from said lower olefin feed stream, and without separating the components of a process stream in a distillation zone.

15. The product gasoline of claim 14 wherein it is enriched with from about 5% to about 25% by weight with said $C_8$+ dialkyl ethers, and said dialkyl ethers are selected from the group consisting of isopropyl and sec-butyl ethers of said $C_5$–$C_{10}$ olefins; and, said dialkyl ethers provide at least a five-fold higher boost in octane number, on the basis of oxygen content (% by wt), than methyl ethers of said $C_5$–$C_{10}$ olefins.

16. An ether-rich gasoline product essentially free from methyl-tert butyl ether, without blending a base gasoline with ethers in a finishing step, by a) feeding a first predominantly $C_3$–$C_4$ olefins feed stream to an olefin hydration zone, and a second predominantly $C_4$–$C_6$= feed stream to an oligomerization zone, b) converting at least 30% by weight of the $C_3$–$C_4$ olefins in said first feed stream to alcohols under hydration conditions to produce an aqueous mixture essentially free of n-propanol, comprising isopropyl alcohol and sec-butyl alcohol with $C_3$–$C_4$ primary alcohols, said mixture flowing from said hydration zone as a hydration effluent, c) converting at least 50% by weight of the $C_4$–$C_6$ olefins in said second feed stream under oligomerization conditions to yield a $C_5$–$C_{10}$ olefin-containing distillate containing at least 15% tert-alkenes flowing from said oligomerization zone is an oligomerized effluent, d) separating an alcohol-rich stream from said hydration effluent and flowing said alcohol-rich stream to a first extraction zone, e) separating a substantially $C_5$–$C_{10}$ olefinic stream from $C_{10}$+ components in said oligomerized effluent and flowing said substantially $C_5$–$C_{10}$ olefinic stream to said first extraction zone, f) extracting said alcohols from said hydration effluent into said gasoline stream under conditions favorable to selective extraction of the mixture until a sufficient quantity of secondary alcohols is extracted into the extract to etherify at least 80% by wt of the tert-olefins in the gasoline solvent, and there is less than 5% by wt of $C_5$–$C_{10}$ olefin-containing gasoline in the raffinate, g) etherfying the extract in the presence of an acidic catalyst under conditions to produce an etherated effluent consisting essentially of
(i) unreacted alcohols,
(ii) asymmetrical $C_8^+$ dialkyl ethers (having a total of 8 or more C atoms) of the $C_5$–$C_{10}$ olefin-containing gasoline, and,
(iii) said gasoline containing $C_5$–$C_{10}$ olefins in which at least 90% of the non-tert-olefins are left unreacted, and, h) extracting the etherated effluent with water under extraction conditions favorable to selective extraction of unwanted $C_3$–$C_4$ alcohols, to yield product gasoline essentially free from said $C_3$–$C_4$ alcohols, and enriched with etherated tert-olefins;

whereby said lower olefin feed stream is upgraded to said product gasoline without using a hydrocarbon stream not generated from said lower olefin feed streams.

17. The ether-rich product gasoline of claim 16 enriched with from about 5% to about 25% by weight of said $C_8^+$ dialkyl ethers, and said dialkyl ethers are selected from the group consisting of isopropyl and sec-butyl ethers of said $C_5$–$C_{10}$ olefins characterized by a pattern of peaks, in a gas chromatographic spectrum, for $C_8^+$ ethers; and, an improvement in octane number, on the basis of the oxygen content of said gasoline product (% by wt O), which improvement is greater than that provided by methyl ethers of said tert-olefins when the ethers in each is present in the amount of 10% by weight.

18. The process of claim 8 including, after step (b) and before step (c), the additional steps of separating an alcohol-enriched stream from said hydration effluent, said alcohol-enriched stream having more than 50% by weight alcohols, and, flowing said alcohol-enriched stream to said first extraction zone.

19. A self-contained, integrated process for upgrading the value of first predominantly $C_3$–$C_4$ olefins and second predominantly $C_4$–$C_6$ olefins feed streams, comprising, a) feeding said first feed stream to an olefin hydration zone, and said second feed stream to an oligomerization zone, b) converting at least 30% by weight of the $C_3$–$C_4$ olefins in said first feed stream to alcohols under hydration conditions to produce an aqueous mixture essentially free of n-propanol comprising isopropyl alcohol and sec-butyl alcohol with $C_3$–$C_4$ primary alcohols, said mixture flowing from said hydration zone as a hydration effluent, c) converting at least 50% by weight of the $C_4$–$C_6$ olefins in said second feed stream under oligomerization conditions to yield a $C_5$–$C_{10}$ olefin-containing distillate containing at least 15% tert-alkenes flowing from said oligomerization zone as an oligomerized effluent, d) separating an alcohol-rich stream from said hydration effluent and flowing said alcohol-rich stream to a first extraction zone, e) separating a substantially $C_5$–$C_{10}$ olefinic stream from $C_{10}^+$ components in said oligomerized effluent and flowing said substantially $C_5$–$C_{10}$ olefinic stream to said first extraction zone, f) extracting said alcohols from said hydration effluent into said gasoline stream under conditions favorable to selective extraction of the mixture until a sufficient quantity of secondary alcohols is extracted into the extract to etherify at least 80% by wt of the tert-olefins in the gasoline solvent, and there is less than 5% by wt of $C_5$–$C_{10}$ olefin-containing gasoline in the raffinate, g) etherifying the extract in the presence of an acidic catalyst under conditions to produce an etherated effluent consisting essentially of
(i) unreacted alcohols,
(ii) asymmetrical $C_8^+$ dialkyl ethers (having a total of 8 or more C atoms) of the $C_5$–$C_{10}$ olefin-containing gasoline, and,
(iii) said gasoline containing $C_5$–$C_{10}$ olefins in which at least 90% of the non-tert-olefins are left unreacted, and, h) extracting the etherated effluent with water under extraction conditions favorable to selective extraction of unwanted $C_3$–$C_4$ alcohols, to yield product gasoline essentially free from said $C_3$–$C_4$ alcohols, and enriched with etherated tert-olefins;

whereby said lower olefin feed stream is upgraded to said product gasoline without using a hydrocarbon stream not generated from said olefin feed streams.

* * * * *